US005762075A

United States Patent [19]

Hoppe et al.

[11] Patent Number: 5,762,075

[45] Date of Patent: Jun. 9, 1998

[54] METHOD OF AND APPARATUS FOR ASCERTAINING THE DENSITY OF A STREAM OF FIBROUS MATERIAL

[75] Inventors: Reinhard Hoppe, Tespe; Henning Möller; Andreas Noack, both of Hamburg, all of Germany

[73] Assignee: Hauni Maschinenbau AG, Hamburg, Germany

[21] Appl. No.: 797,946

[22] Filed: Feb. 12, 1997

[30] Foreign Application Priority Data

Feb. 15, 1996 [DE] Germany ..... 196 05 618.7

[51] Int. Cl.[6] ..... A24C 5/14

[52] U.S. Cl. ..... 131/84.1; 131/84.2; 131/84.3; 131/281

[58] Field of Search ..... 131/84.1, 84.2, 131/84.3, 84.4, 281, 108, 905, 906

[56] References Cited

U.S. PATENT DOCUMENTS

| | | | |
|---|---|---|---|
| 3,056,026 | 9/1962 | Bigelow | 131/84.4 |
| 4,424,443 | 1/1984 | Reuland | 131/84.4 |
| 4,785,830 | 11/1988 | Möller et al. | 131/84.1 |
| 4,805,641 | 2/1989 | Radzio et al. | 131/84.4 |
| 4,865,052 | 9/1989 | Hartmann et al. | 131/84.4 |

*Primary Examiner*—Aaron J. Lewis
*Assistant Examiner*—Charles W. Anderson
*Attorney, Agent, or Firm*—Spencer & Frank

[57] ABSTRACT

The density of a wrapped rod-like filler of tobacco or filter material for tobacco smoke is ascertained by causing successive increments of the filler to traverse beams of X-rays which, after having penetrated through small portions of the filler, impinge upon detectors forming a linear array and serving to generate (first) signals denoting the intensities of the respective beams. Such intensities are affected by the densities of the respective portions of the filler. The first signals are processed in a circuit together with one or more additional signals denoting the intensity or intensities of one or more beams which bypass the filler, and with one or more further signals furnished by one or more detectors which are shielded from the source of X-rays. The thus obtained (second) signal denotes the densities of successive increments of the filler and is used to correct the density of the filler, if and when necessary. The processing of first, additional and further signals in the circuit can involve a summing with or without preceding logarithmizing, or multiplying of the first signals and logarithmizing the thus obtained product.

18 Claims, 2 Drawing Sheets

METHOD OF AND APPARATUS FOR ASCERTAINING THE DENSITY OF A STREAM OF FIBROUS MATERIAL

BACKGROUND OF THE INVENTION

The invention relates to improvements in methods of and in apparatus for ascertaining or determining the density of flows (such as streams or rods) of fibrous materials, especially those which are utilized in the tobacco processing industry in connection with the making of plain or filter cigarettes, cigars, cigarillos or other rod-shaped smokers' products. The material of the flow can be natural, reconstituted or artificial tobacco and/or filter material for tobacco smoke.

Rod making machines for mass production of cigarettes, cigars or other rod-shaped smokers' products (hereinafter referred to as cigarettes for short) are normally equipped with apparatus for continuous monitoring of the density of a flow of fibrous material prior and/or subsequent to draping of the flow (e.g., a trimmed or equalized rod-like filler of comminuted tobaco leaf laminae) into a web of cigarette paper, tipping paper or other suitable wrapping material. Uniform density as well as a density which at least closely approximates a predetermined optimum value are very important criteria which determine the quality (such as the appearance, the deformability and/or other parameters) of rod-shaped smokers' products and filter mouthpieces or filter tips of such products. The density of fibrous material in the tubular envelope of a plain or filter cigarette or another rod-shaped smokers' product is indicative of the filling (compactness) of the product, i.e., of the quantity of fibrous material therein. Among other influences, the quantity and the uniformity or lack of uniformity of the distribution of fibrous material in the tubular envelope determine the resistance which the tobacco filler and the filter mouthpiece offer to the flow of tobacco smoke therethrough.

U.S. Pat. No. 4,424,443 (granted Jan. 3, 1984 to Reuland for "Apparatus for measuring the density of cigarette rods or the like") discloses an apparatus which employs a source of penetrative nuclear radiation (such as strontium-90). The radiation is directed across a moving flow of fibrous material and the extent to which the intensity of radiation (such as beta rays) is reduced as a result of penetration through the flow is indicative of the density of tested increments of the flow. An important advantage of density measuring apparatus which employ penetrative nuclear radiation is their reliability, i.e., the density measurements are highly accurate. However, the utilization of such density measuring apparatus involves substantial expenditures for safety equipment in order to properly confine such radiation to the testing station.

A more recent proposal (disclosed in U.S. Pat. No. 4,805,641 granted Feb. 21, 1989 to Radzio et al. for "Method and apparatus for ascertaining the density of wrapped tobacco fillers and the like") involves the utilization of ultraviolet, infrared or visible light. Such proposal is quite satisfactory as far as the safety of attendants in the plant for the making of smokers' products is concerned; however, the reliability of density measurements is not as high as that of the measurements which are carried out by resorting to a source of penetrative nuclear radiation.

U.S. Pat. No. 3,056,026 (granted Sep. 25, 1962 to Bigelow for "Cigarette density gage") proposes to carry out density measurements by resorting to a source of X-rays. The basic principle is the same as that involving the utilization of penetrative nuclear radiation. The beam of X-rays which has penetrated through the flow of fibrous material is monitored in a dual ion chamber. The utilization of such chamber limits the rate at which the density of a moving rod can be ascertained (i.e., the speed at which the rod can be advanced through the testing station). Moreover, the resolution (as considered in the longitudinal direction of a continuous rod to be tested) is rather unsatisfactory.

A further density measuring apparatus which also relies on X-rays is disclosed in U.S. Pat. No. 4,785,830 (granted Nov. 22, 1988 to Möller et al. for "Method and apparatus for monitoring and evaluating the density of a tobacco stream"). The patent proposes to direct X-rays through an unwrapped stream or flow of fibrous material which is confined to advancement within a channel. The radiation which has penetrated through the stream is monitored by an array of sensors in order to determine the densities of several layers of the moving stream, i.e., to separately ascertain the densities of discrete strata of the advancing flow of fibrous material. This enables the density measuring apparatus to furnish signals which are utilized to independently influence the buildup of the flow of fibrous material, i.e., to vary the density of fibrous material during the formation of the flow upstream of the density measuring or monitoring station. The patentees propose to employ the apparatus for the measurement of density of wrapped or unwrapped flows of fibrous material; however, no specific disclosure how to convert or adapt the patented apparatus for the measurement of density of a rod-like filler which is confined in a tubular envelope of cigarette paper or the like is actually disclosed in the patent to Möller et al.

U.S. Pat. No. 4,865,052 discloses an apparatus for the determination of density of a flow or stream of fibrous material upstream of a wrapping station. The density monitoring apparatus employs a source of X-rays which are caused to penetrate across a stream of tobacco particles in a channel. The characteristics of the radiation which has pentrated through the unwrapped stream are monitored by an array of sensors, and the thus obtained signals are added starting with the signal denoting the density of a layer at the bottom of the channel. When the sum reaches a predetermined value, the trimming or equalizing (surplus removing) device downstream of the density measuring station is adjusted so that it removes a larger or a smaller quantity of fibrous material from the advancing stream. This amounts to an advance determination or selection of the weight (density) of the rod-like filler in the tubular envelope of the continuous rod which is thereupon subdivided into cigarettes, cigars, cigarillos or filter rod sections of desired length. It has been found that such procedure is not satisfactory in connection with the determination of the density of successive increments of a rod which is to be subdivided into a file of plain cigarettes.

To summarize: Density measuring apparatus which employ penetrative nuclear radiation are reliable and accurate; however, their initial and maintenance costs are very high. On the other hand, the presently known density measuring apparatus which operate with X-rays do not meet the standards expected from a density measurements particularly in a modern cigarette making machine.

OBJECTS OF THE INVENTION

An object of the invention is to provide a novel and improved method of ascertaining the density of a moving flow (such as a rod-like filler in a tubular envelope of cigarette paper or other suitable wrapping material) by resorting to X-rays.

Another object of the invention is to provide a method which can be resorted to and can furnish highly accurate and reliable measurements in connection with the determination of density of flows containing all types of fibrous materials which are being processed in connection with the making of various smokable products with or without filter mouthpieces as well as in connection with the determination of density of flows of filter material for tobacco smoke.

A further object of the invention is to provide a relatively simple, compact, highly reliable and safe apparatus for the determination of densities of flows of fibrous material of the tobacco processing industry.

An additional object of the invention is to provide a novel and improved density measuring apparatus which employs a source of X-rays.

Still another object of the invention is to provide a density measuring apparatus which can be installed in existing types of machines for the making of cigarettes, cigars, cigarillos, cheroots or filter rods for tobacco smoke.

A further object of the invention is to provide the apparatus with novel and improved means for processing signals which are indicative of the densities of various portions of an advancing flow of fibrous material of the tobacco processing industry.

Another object of the invention is to provide a novel grouping of detectors for the characteristics of X-rays in an apparatus of the above outlined character.

SUMMARY OF THE INVENTION

One feature of the present invention resides in the provision of a novel and improved method of ascertaining the density of an advancing flow of fibrous material of the tobacco processing industry (e.g., a stream or filler of shredded and/or otherwise comminuted tobacco leaves). The method comprises the steps of confining the flow to advancement along a predetermined path, directing beams of X-rays across the path so that the beams penetrate through different portions of the flow and the intensity of the beams is influenced by the densities of the respective (irradiated) portions of the flow, generating first signals which denote the thus influenced intensities of the beams, and processing the first signals into a single second signal which denotes the density of the flow.

The portions of the flow which are to be impinged upon by the beams of X-rays are or can be sufficiently small to ensure that the density of each such portion of the flow is at least substantially homogeneous (uniform).

The processing step can include processing the first signals with at least one reference signal which denotes the intensity of a beam of X-rays that bypasses the predetermined path, i.e., the intensity of a beam which was not caused to penetrate through any portion of the flow. In addition to or in lieu of such processing, the latter can include a summing or adding of the first signals, particularly logarithmizing and subsequent summing of the first signals. Still further, the processing step can include multiplying the first signals and logarithmizing the thus obtained product of the first signals.

The method can further comprise the step of generating at least one dark signal, and the processing step of such method can include utilizing the at least one dark signal to compensate for eventual drift of X-ray detectors which are utilized to generate the first signals.

Another feature of the instant invention resides in the provision of a novel and improved apparatus for ascertaining the density of a flow (such as a stream or a rod-like filler) of fibrous material of the tobacco processing industry which is advanced along a predetermined path. The apparatus comprises means for directing beams of X-rays across a predetermined region of the path so that the beams penetrate through different portions of an increment of the flow in the aforementioned region of the path and the intensities of the beams are influenced by the densities of the respective portions of the flow, means for generating first signals which denote the thus influenced intensities of the beams, and means for processing the first signals into a single second signal denoting the intensity of the tested increment of the flow. The signal generating means can comprise an at least substantially linear array of X-ray detectors, at least one for each of the different portions of the increment of the flow in the aforementioned region of the path.

The apparatus can further comprise means for transmitting to the processing means at least one reference signal denoting the intensity of a further beam of X-rays wich is (or which can be) furnished by the directing means and bypasses the predetermined path, i.e., which was not caused to penetrate through the fibrous material.

The apparatus can also comprise means for transmitting to the processing means at least one dark signal which is utilized to influence the first signals, particularly for the purpose of compensating for eventual drifts of the X-ray detectors. The means for transmitting the at least one dark signal can include an additional X-ray detector which is shielded from the directing means.

The means for processing the first signals can comprise means for summing or adding the first signals and for converting the thus generated further signal (denoting the sum of the first signals) into the second signal. Such signal processing means can further comprise means for logarithmizing the first signals prior to the generation of the further signal by the summing means.

It is also possible to employ processing means which comprises means for multiplying the first signals to furnish a further signal which denotes the product of the first signals, and means for logarithmizing the further signal.

As already pointed out above, it is presently preferred to select the dimensions of the portions of the increment of the flow in the aforementioned region of the predetermined path in such a way that their densities are at least substantially uniform (homogeneous).

By way of example, the aforementioned linear array of X-ray detectors can comprise between 5 and 25 detectors, particularly between 10 and 20 detectors.

The processing means can transmit each second signal to suitable means for controlling the density of the flow as a function of the characteristics of the second signal.

The novel features which are considered as characteristic of the invention are set forth in particular in the appended claims. The improved apparatus itself, however, both as to its construction and the mode of installing and utilizing the same, together with numerous additional important and advantageous features thereof, will be best understood upon perusal of the following detailed description of certain presently preferred specific embodiments with reference to the accompanying drawings.

DESCRIPTION OF PREFERRED EMBODIMENTS

Figure 1:
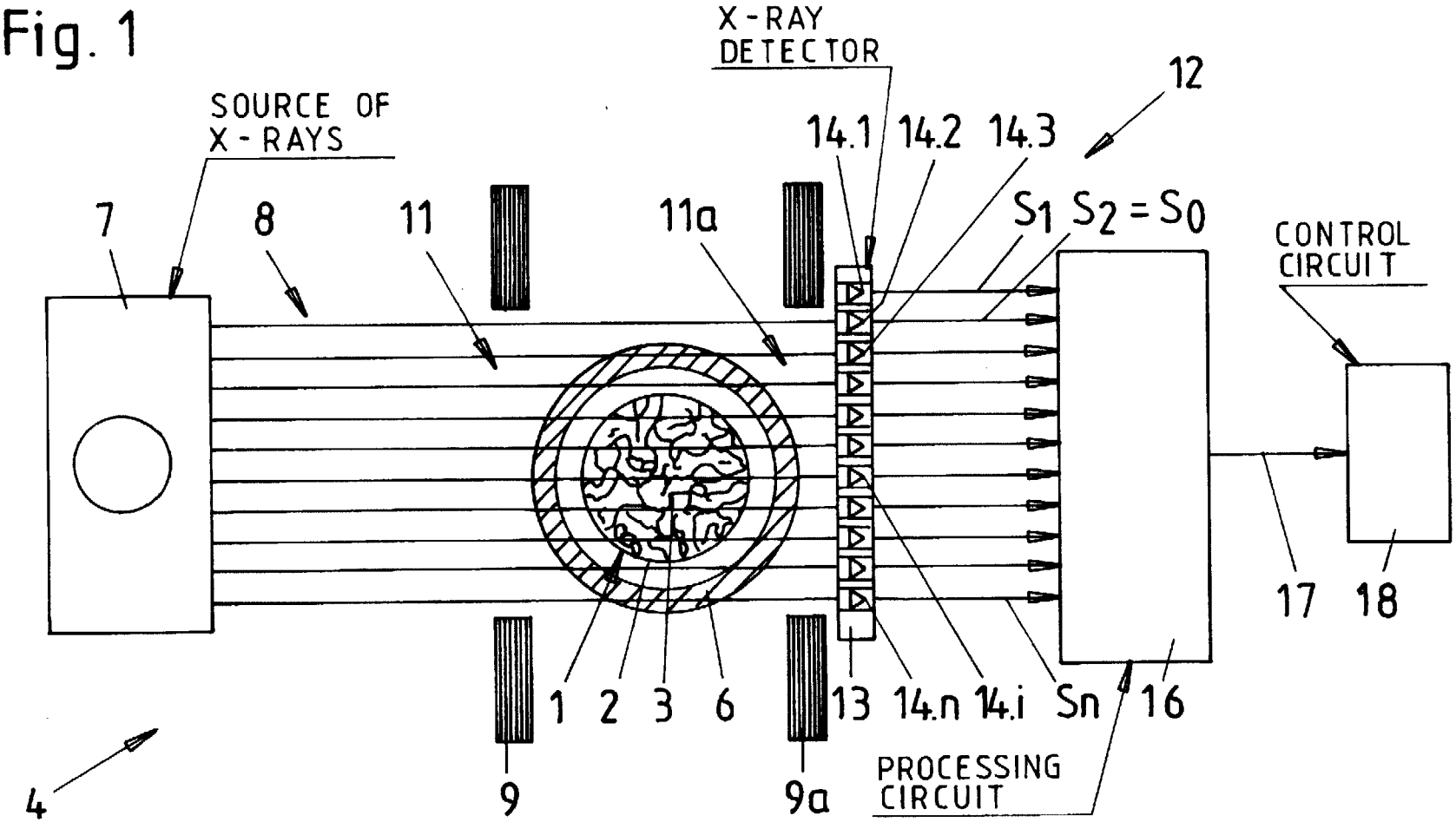
FIG. 1 is a schematic elevational view of an apparatus which embodies one form of the invention and is positioned to ascertain the density of successive increments of a rod-like tobacco filler in a tubular envelope of cigarette paper or other suitable wrapping material.

FIG. 1 illustrates an apparatus which is designed to measure the densities of successive increments of the rod-like filler 3 of a continuous cigarette rod 1 having a tubular envelope 2 of cigarette paper or other suitable material. The rod 1 is assumed to advance in a direction at right angles to the plane of FIG. 1 within the confines of a tubular guide 6, at least during advancement through a density measuring or testing station 4. The rod-like filler 3 within the tubular envelope 2 of the illustrated rod 1 is assumed to contain tobacco particles of the type utilized for the making of cigarettes, cigars, cigarillos or cheroots; however, it is equally possible to utilize the improved apparatus for the determination of density of successive increments of a continuous rod containing a rod-like filler of filter material for tobacco smoke.

By way of example, the density measuring apparatus of FIG. 1 can be installed in a cigarette rod making machine of the type known as Protos 100 (distributed by the assignee of the present application). The material of the guide 6 is selected in such a way that it is permeable to X-rays. For example, the guide 6 can be made of relatively thin sheet material consisting of aluminum or titanium. A presently preferred material of the guide 6 is a polycarbonate, for example MACROLON (Trademark) available at BAYER AG, or a polyethylene etherketone having a wall thickness in the range of 0.2 mm. The thickness of the guide 6 which is shown in FIG. 1 is exaggerated for the sake of clarity, and the illustrated guide is shown as being made of a metallic material.

A suitable source 7 of X-rays is provided at the station 4 to serve as means for directing beams 8 of X-rays across a selected increment of the path for the advancement of the rod 1 and its filler or flow 3 within the confines of the guide 6. The representation of the beams 8 as being a set of exactly parallel rays is a simplified or idealized representation; actually, the beams 8 are not exactly parallel to each other. Therefore, the apparatus is provided with two diaphragms 9 and 9*a* which are respectively installed upstream and downstream of the guide 6 and respectively define apertures 11 and 11*a* for the passage of a set of beams of X-rays across different portions of successive increments of the filler 3 in the guide 6. The provision of such diaphragms has been found to suffice to ensure the traversal of the filler 3 by a set of beams of X-rays which can be said to be more or less parallel to each other.

A presently preferred source 7 is an industrial X-ray apparatus known as Type MF1-30-2 having a normal-focus X-ray tube FK 60-10 W and being distributed by the Firm Rich. Seifert & Co., D-22926 Ahrensburg, Federal Republic Germany.

The means for measuring the intensity of those beams 8 of X-rays which have penetrated through different portions of the increment of the filler 3 at the station 4 includes a receiver 12 which is located downstream of the aperture 11*a* of the diaphragm 9*a* and comprises a linear array 13 of X-ray detectors 14. Not all of these detectors are located in the path of beams 8 which have penetrated across the filler 3 in the guide 6. Depending on the diameter of the rod 1, the detectors 14.3 to 14.n can be expected to receive radiation which has passed through the filler 3.

In the apparatus of FIG. 1, n=11, i.e., the total number of detectors 14 exceeds ten. It has been found that very satisfactory results can be obtained by utilizing an array 13 which contains sixteen X-ray detectors 14. Such arrays can be obtained from the Firm CRYSTAL under the designation Type CXM-HS-03-16K. In FIG. 1, the character i denotes a number somewhere between 1 and n. Each of the detectors 14 can have an X-ray sensitive surface with an area of 1 mm×4 mm (as measured vertically and at right angles to the plane of FIG. 1, respectively). The width of the apertures 11 and 11*a* can equal or approximate 4 mm, i.e., the same as the width of radiation-sensitive surfaces of the detectors 14.

In accordance with a feature of the improved density measuring apparatus, the output of each of the detectors 14.1 to 14.n is individually connected to the corresponding input of a novel and improved circuit 16 which evaluates and processes the (first) signals from those detectors (such as 14.3 to 14.n) located in the path of beams 8 which have passed through and the intensities of which were actually influenced by the densities of the corresponding portions of that increment of the filler 3 which happens to be located at the station 4. The circuit 16 processes such (first) signals and transmits a second signal 17 which is indicative of the density of the respective tested increment of the filler 3. The signal 17 can be transmitted to a control circuit 18 which either indicates the actual density or which can serve as a means for directly or indirectly regulating the density of the filler 3, e.g., by properly adjusting the trimming or equalizing device which is a standard part of a cigarette rod maker and serves to remove the surplus from a stream or flow of tobacco particles which are to be draped into a web of cigarette paper or the like. Reference may be had, for example, to the aforementioned U.S. Pat. No. 4,805,641 to Radzio et al. wherein a trimming or equalizing device is shown in FIG. 1, as at 19.

The array 13 contains at least one detector (shown at 14.2) located in the path of a beam 8 which has bypassed the filler 3 at the testing station 4. This detector 14.2 transmits to the corresponding input of the processing circuit 16 a reference signal S2, and such signal is processed with signals (such as Sn) denoting the intensities of beams 8 having passed through that increment of the filler 3 which happens to be located at the station 4. Though FIG. 1 shows a single detector (14.2) for the generation of a reference signal (S2), the apparatus can be designed to furnish to the processing circuit 16 two or more reference signals, i.e., signals generated by those beams 8 which did not penetrate through fibrous material on their way from the aperture 11 to and beyond the aperture 11a.

Still further, the array 13 contains at least one detector (shown at 14.1) which is permanently shielded from the radiation issuing from the source 7. The detector 14.1 transmits to the corresponding input of the processing circuit 16 a dark signal S1 which is being evaluated by the circuit 16 in order to compensate for drift phenomena in the detectors 14. The quality of the density measuring action can be enhanced by employing several detectors for the generation of reference signals (S2) and by employing several detectors for the generation of two or more dark signals (S1).

Figure 2:
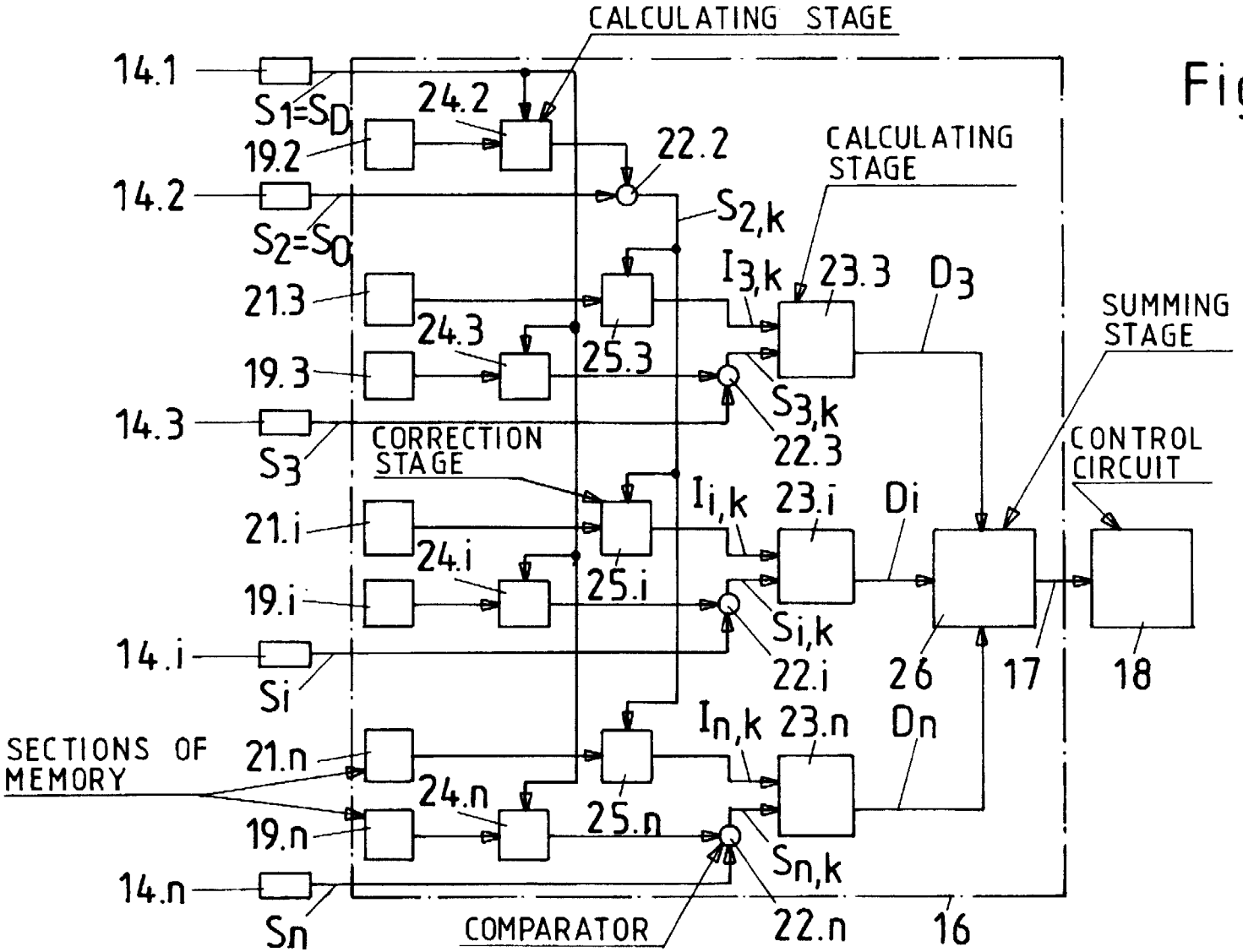
FIG. 2 is a block diagram of the signal processing or evaluating circuit in the density measuring apparatus of FIG. 1.

The mode of operation of the density measuring apparatus of FIG. 1 will be explained with reference to the block diagram of the processing or evaluating circuit 16 which is shown in FIG. 2. More specifically, FIG. 2 illustrates the mode of converting the signals S1 to Sn from the detectors 14 of the array 13 into the second signal 17 which is transmitted to the control circuit 18.

The first step involves a calibration of the density measuring apparatus. To this end, the source 7 of X-rays 8 is turned off or the diaphragm 9 is closed so that the size of the aperture 11 is reduced to zero and the receiver 12 is sealed from the source 7. Thus, each of the signals S1 to Sn from the respective detectors 14.1 to 14.n is a dark signal. The same result can be achieved by turning the surce 7 off, i.e., this also entails that each of the detectors 14.1 to 14.n transmits a dark signal corresponding to the signal S1.

The circuit 16 compares the dark signals from the detectors 14.2 to 14.n with the dark signal S1 from the detector 14.1 (this dark signal is also called a signal SD for more convenient identification). The circuit 16 processes the dark signals from the detectors 14.2 to 14.n into compensation values jD.2 to jD.n, and such values or data are stored in the memory sections 19.2 to 19.n of the circuit 16 as constants for use during actual processing of those first signals S3 to Sn which indicate the densities of those portions of the filler 3 which were actually traversed by the respective beams 8 of X-rays. The next step of the calibrating operation involves the turning on of the source 7, and the intensities of the beams 8 are evaluated at 14.2 to 14.n prior to causing a rod 1 to advance in the guide 6 through the density measuring or testing station 4. Thus, the signals S3 to Sn are then indicative of the intensities of beams 8 which did not pass through the filler 3. The thus obtained signals S3 to Sn are reference signals, the same as the signal S2 (which is a reference signal also designated as the signal S0). The circuit 16 processes the signals S2 to Sn (reference signals) to provide reference values j0.3 to j0.n, and such reference values are stored in the respective memory sections 21.3 to 21.n of the evaluating circuit 16 as constants.

In order to proceed with a density measuring operation, a rod 1 is caused to advance through the guide 6 and across the testing station 4 in a direction at right angles to the plane of FIG. 1. The radiation source 7 is on so that the beams 8 which are being propagated toward the detectors 14.3 to 14.n penetrate through the filler 3 and their intensities are influenced (weakened) to an extent corresponding to the densities of the respective portions of the increment of fibrous material then advancing through the station 4. The detectors 14.3 to 14.n are located in the paths of propagation of such beams 8 and generate first signals S3 to Sn which are indicative of the influenced intensities of the respective beams 8. The processing circuit 16 compares such signals S3 to Sn with the compensation values jD.3 to jD.n in the corresponding function units 22.3 to 22.n (i.e., with the dark signals of the detectors 14.3 to 14.n). The compensation values are continuously corrected in the calculating stages 24.3 to 24.n as a function of the then effective or valid dark signal SD from the continuously shielded X-ray intensity detector 14.1. This results in a compensation for drift phenomena which might develop in the detectors 14. For example, such drifting can be the result of aging of the detectors 14 or it might be attributable to migration of their thermal characteristics. The comparators 22.3 to 22.n of the processing circuit 16 transmit to the respective calculating stages 23.3 to 23.n corrected measurement signals S3.k to Sn.k, and such signals are indicative of the intensities of those beams 8 which have impinged upon the respective detectors 14.3 to 14.n subsequent to the passage through the corresponding portions of the increment of the filler 3 at the testing station 4. In other words, such signals are indicative of the densities of the respective portions of the filler 3 at the station 4.

At the same time, the calculating stages 23.3 to 23.n of the processing circuit 16 receive reference signals I3.k to In.k. Such reference signals are obtained from the reference values j0.3 to j0.n which are stored in the memory sections 21.3 to 21.n and are continuously corrected (in correction stages 25.3 to 25.n) on the basis of the reference signal S2 (S0) which is supplied by the detector 14.2, i.e., by the detector which is uninterruptedly exposed to the action of that beam 8 which bypasses the filler 3.

A correction signal S2.k is generated in the comparator stage 22.2 on the basis of a comparison: (in the stage 24.2) of the reference value (constant) jD.2 of the signal from the detector 14.2 with the dark signal SD from the continuously shielded detector 14.1, and such correction signal S2.k is used in the correction stages for a correction of the reference values j0.3 to j0.n. In this manner, the provision of the additional detector 14.2 (which permanently furnishes a reference signal S2 (S0)), and of the detector 14.1 (which continuously furnishes a dark signal S1 to be used as a compensating signal) renders it possible to ensure that the density measurement is not affected by eventual fluctuations of the intensity of radiation issuing from the source 7, by eventual drifts of the temperature and/or by eventual aging of the detectors 14.

The corrected measurement signals S3.k to Sn.k are processed in the calculating stages 23.3 to 23.n with the corrected reference signals I3.k to In.k to obtain discrete density signals D3 to Dn each of which is accurately indicative of the density of the corresponding portion of that increment of the filler 3 which is located at the testing station 4. This is carried out by logarithmizing the ratio (quotient) of the reference signal and the corrected measurement signal. The thus obtained discrete density representing signals D3 to Dn are transmitted to an adding or summing stage 26 wherein they are added to form the second signal 17 denoting the density of the respective increment of the filler 3. The signal 17 is transmitted to the control circuit 18 for the purpose as fully described hereinbefore.

It is also possible to process the signals D3 to Dn into a signal which is indicative of the average values of such signals and also denotes the density of the filler 3. The logarithmizing of individual signals in the stages 23 exhibits (in comparison with conventional logarithmizing of the integrated density value) the important advantage that one obtains a mathematically correct (and hence a more reliable and more accurate) indication concerning the density of the then irradiated increment of the filler 3 of fibrous material.

Another possibility of processing the first signals from the detectors 14.3 to 14.n is to first multiply the quotients of the reference signals and the corresponding corrected measurement signals, and to thereupon logarithmize the thus obtained product in order to obtain the desired second signal 17 indicating the density of the then monitored increment of the filler 3.

It is preferred to utilize detectors 14 having small or very small areas which are exposed to X-rays passing through the aperture 11a of the diaphragm 9*a*. As mentioned above, it is possible to employ detectors having radiation-sensitive surfaces in the range of 1 mm times 4 mm. In other words, each of these detectors generates a first signal S which is indicative of the density of a very small portion of the filler 3; this is of advantage because one can safely assume that the density of each such small portion of the filler is at least substantially homogeneous (uniform). This, too, contributes significantly to the accuracy of the second signal 17 which is being transmitted to the control circuit, either for display or for display and an alteration of the density upstream of the station 4 or solely for the purposes of density alteration. The reason is that the logarithmizing of the individual intensity values constitutes a mathematically correct evaluating step and reduces or eliminates the likelihood of distortion of the results of the processing operation. Furthermore, such design of the detectors renders it possible to achieve a very high resolution.

It is well known that, during penetration through a mass, the softer fractions of a radiation are absorbed to a greater extent than the harder fractions, i.e., a high percentage of the harder fraction of radiation is likely to penetrate through the mass. This phenomenon is known as a "hardening" of radiation consisting of X-rays. It is possible to empirically determine correction factors for particular types of materials or substances to be exposed to beams of X-rays, and to use the thus obtained factors to correct the signals (such as from the detectors 14) in order to account for the aforementioned hardening of X-rays. This results in a further improvement of the quality (accuracy and reliability) of the density measuring operation.

An important advantage of the improved method and apparatus is that the density of successive increments of a flow of fibrous material can be ascertained at a rate which is necessary in a machine (such as a cigarette rod making machine) wherein the filler must be advanced at an elevated speed, namely at a speed which is required to turn out well in excess of 10,000 plain cigarettes per minute. Furthermore, the resolution of the density measurement is highly satisfactory because one can readily compensate for eventual drift phenomena in the X-ray detectors as well as for eventual fluctuations of the radiation (beams 8) issuing from the source 7.

The above outlined highly satisfactory density measurements can be arrived at by resorting to a suitable source of X-rays rather than to a source of penetrative nuclear radiation (such as beta rays) with the aforediscussed attendant problems particularly the expensive undertakings which are necessary to shield the attendants from penetrative radiation. In fact, it is possible to design the source 7 of X-rays in such a way that its dimensions will match those of a source of penetrative nuclear radiation. In other words, it is possible to replace a properly designed source 7 of X-rays for a presently utilized source of beta rays or other penetrative nuclear radiation.

To logarithmize a given value means to find the logarithm of said value.

The block diagram of FIG. 2 shows the circuit in a schematic form for the sake of convenience and simplicity. In actual practice, e.g., in a cigarette maker, the evaluating circuit preferably comprises a computer wherein the aforediscussed parts do not constitute discrete elements but the computer performs the aforedescribed logarithmizing and other evaluating operations with the same result.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of density measurement and, therefore, such adaptations should and are intended to be comprehended within the meaning and range of equivalence of the appended claims.

What is claimed is:

1. A method of ascertaining the density of an advancing flow of fibrous material of the tobacco processing industry, comprising the steps of confining the flow to advancement along a predetermined path; directing beams of X-rays across said path so that said beams penetrate through different portions of the flow and the intensity of said beams is influenced by the densities of the respective portions of the flow; generating first signals denoting the thus influenced densities of said beams; simultaneously generating at least one reference signal from said directed beams of X-rays by directing a portion of said directed beams of X-rays in a direction which bypasses the advancing flow of fibrous material; and processing said first signals into a single second signal denoting the density of the flow, including processing said first signals with said at least one reference signal.

2. The method of claim 1, wherein said portions of the flow have at least substantially homogeneous densities.

3. The method of claim 1, wherein said processing step includes summing of said first signals.

4. The method of claim 1, wherein said processing step includes logarithmizing and subsequent summing of said first signals.

5. The method of claim 1, wherein said processing step includes multiplying said first signals and logarithmizing the thus obtained product of said first signals.

6. The method of claim 1, further comprising the step of generating at least one dark signal, said processing step including utilizing said at least one dark signal to compensate for eventual drift of X-ray detectors which are utilized to generate said first signals.

7. Apparatus for ascertaining the density of a flow of fibrous material of the tobacco processing industry which is advanced along a predetermined path, comprising means for directing beams of X-rays across a predetermined region of said path so that said beams penetrate through different portions of an increment of the flow in said region and the intensities of said beams are influenced by the densities of the respective portions of the flow; means for generating first signals denoting the thus influenced intensities of said beams; means for simultaneously generating at least one reference signal from said directed beams of X-rays including means for directing a portion of said directed beams of X-rays in a direction which bypasses the advancing flow of fibrous material; and means for processing said first signals and said at least one reference signal into a single second signal denoting the density of said increment of the flow.

8. The apparatus of claim 7, wherein said signal generating means comprises an at least substantially linear array of X-ray detectors, at least one for each of said different portions of the increment of the flow in said region of said path.

9. The apparatus of claim 8, wherein said signal generating means comprises an at least substantially linear array of X-ray detectors, at least one for each of said different portions of the increment of the flow in said region of said path, said means for transmitting said at least one reference signal including an additional X-ray detector of said array.

10. The apparatus of claim 7, further comprising means for transmitting to said processing means at least one dark signal which is utilized to influence said first signals.

11. The apparatus of claim 7, wherein said signal generating means comprises an at least substantially linear array of X-ray detectors, at least one for each of said different portions of the increment of the flow in said region of said path, and further comprising means for transmitting to said processing means at least one dark signal which is utilized to influence said first signals so as to compensate for eventual drifts of said detectors.

12. The apparatus of claim 11, wherein said means for transmitting said at least one dark signal includes an additional X-ray detector which is shielded from said directing means.

13. The apparatus of claim 7, wherein said processing means comprises means for summing said first signals and for converting the thus generated further signal denoting the sum of said first signals into said second signal.

14. The apparatus of claim 13, wherein said signal processing means further comprises means for logarithmizing said first signals prior to the generation of said further signal.

15. The apparatus of claim 7, wherein said processing means comprises means for multiplying said first signals to furnish a further signal denoting the product of said first signals, and means for logarithmizing said further signal.

16. The apparatus of claim 7, wherein said portions of the increment in said region of said path have at least substantially homogenous densities.

17. The apparatus of claim 7, wherein said signal generating means comprises an at least substantially linear array of X-ray detectors, at least one for each of said different portions of the increment of the flow in said region of said path, said array comprising between 5 and 25 detectors.

18. The apparatus of claim 7, further comprising means for controlling the density of the flow as a function of the characteristics of said second signal.

* * * * *